US005850978A

United States Patent [19]

Jacobson

[11] Patent Number: 5,850,978

[45] Date of Patent: Dec. 22, 1998

[54] SELF TIGHTENING MANTLE RETENTION ASSEMBLY FOR GYRATORY CONICAL CRUSHERS

[75] Inventor: Charles R. Jacobson, Greendale, Wis.

[73] Assignee: Nordberg, Incorporated, Wis.

[21] Appl. No.: 672,627

[22] Filed: Jun. 28, 1996

[51] Int. Cl.[6] ..... B02C 2/04

[52] U.S. Cl. ..... 241/215

[58] Field of Search ..... 241/207, 216, 241/286

[56] References Cited

U.S. PATENT DOCUMENTS 4,012,000 3/1977 Davis et al. .
4,658,638 4/1987 Plahmer .
4,750,681 6/1988 Sawant et al. .
4,956,078 9/1990 Magerowski et al. .
5,042,732 8/1991 Karra et al. .

*Primary Examiner*—Mark Rosenbaum
*Attorney, Agent, or Firm*—Foley & Lardner

[57] ABSTRACT

A self tightening mantle retention assembly for a conical crusher. The self tightening assembly includes a locking bolt or nut provided with external threads for engaging in internally threaded bore in the head of the crusher. The locking bolt is provided with a central bore for receiving a central bolt, the threads of which engage an internally threaded aperture formed in the head or a block secured to the upper bearing supporting the head to apply a further compressive force to the locking bolt. The threaded engagement between the locking bolt and the head and between the bolt threads and the threaded aperture in which they are received, are formed such that the torque applied to the locking bolt by the crushing action on the mandel tends to further tighten the locking bolt to secure the mantle on the head of the crusher.

21 Claims, 2 Drawing Sheets

FIG. 1
(PRIOR ART)
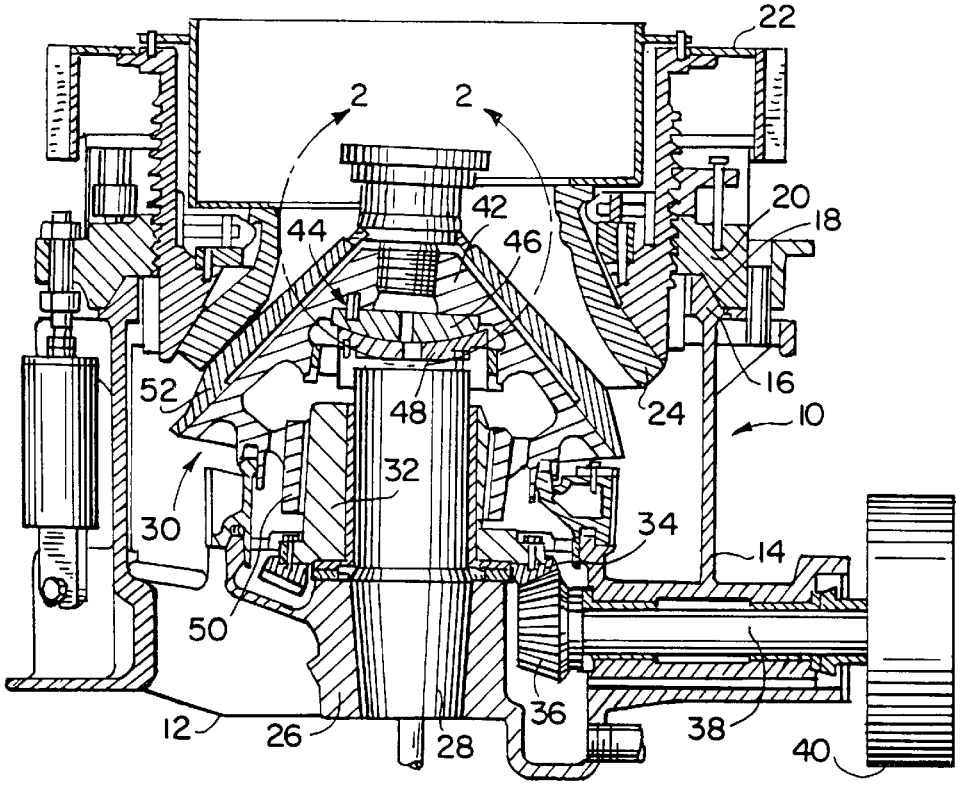
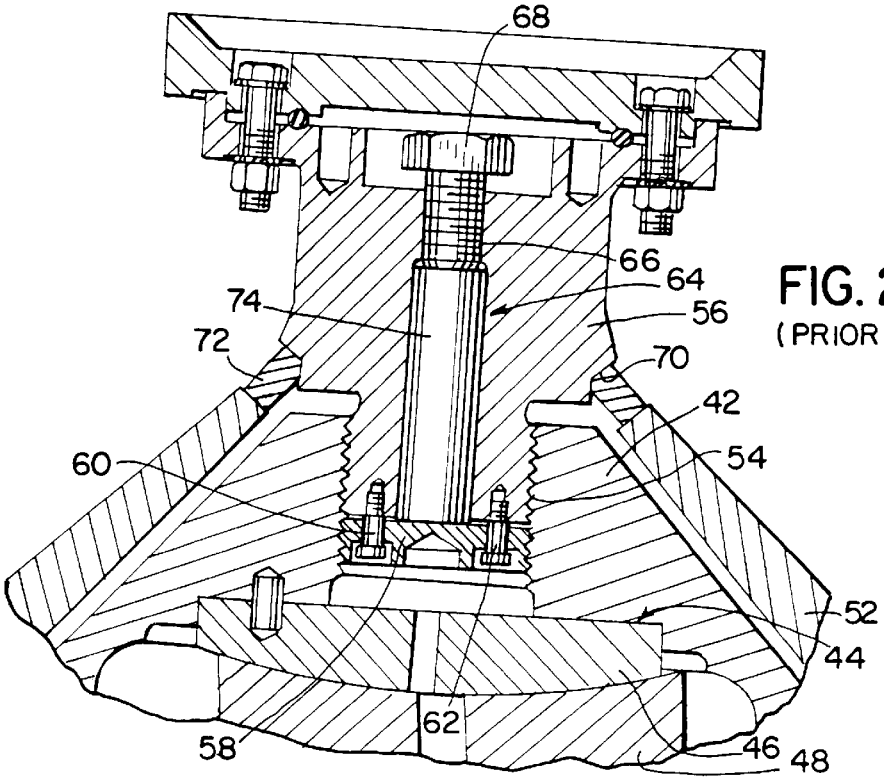
FIG. 2
(PRIOR ART)

SELF TIGHTENING MANTLE RETENTION ASSEMBLY FOR GYRATORY CONICAL CRUSHERS

FIELD OF THE INVENTION

The present invention generally relates to conical crushers. More particularly, it relates to the retention of a mantle on the gyrating crusher head of a gyratory conical crusher.

BACKGROUND OF THE INVENTION

Conical crushers having head assemblies which are caused to gyrate by an eccentric mechanism are commonly available and have been the subject of numerous prior patents. A conical crusher typically has a central hub surrounded by an annular shell on which an annular ring supporting a crusher bowl assembly is mounted for vertical movement with respect to the shell. The crusher bowl assembly, typically including a bowl liner, is supported on the annular ring.

A head assembly is supported within the annular shell by a bearing arrangement on a stationary shaft which is in turn supported by the central hub. The head assembly is provided with an outer liner, typically called a mantle. Gyration of the head assembly relative to the bowl assembly is provided by an eccentric mechanism mounted for rotation about the stationary shaft. Alternatively, conical crushers can utilize various structures and methods for mounting the head assembly with respect to the bowl liner.

A crushing cavity or gap is formed between the bowl liner and the mantle of the head assembly. The crushing cavity can be adjusted by vertically moving the crusher bowl assembly with respect to the crusher head. The bowl liner and the mantle, being subjected to the most severe wear in the crusher, are typically provided as replaceable elements. Thus, it is desirable that the mechanism for retaining the mantle on the head be removable, such that a worn mantle may be removed from the head, and a new mantle installed thereon and retained by the reinstalled retaining mechanism. Difficulties have been experienced in present technology mantle retention systems. Mechanical failures of retention systems (e.g., improperly configured, installed or adjusted retention systems) can be common. Additionally, retention systems sometimes fail to perform their function, resulting in loose mantles and consequential damage to heads and mantles. Further still, conventional retention systems can be difficult to disassemble after a failure especially when the associated threads are altered by the failure.

SUMMARY OF THE INVENTION

The present invention relates to a conical crusher having a gyratory head assembly which is provided with a replaceable mantle. More particularly, it relates to an assembly for retaining a replaceable mantle on a gyratory head assembly which is less subject to mechanical damage. The present invention further relates to a mantle retaining assembly which is self-tightening. Should there be a tendency for a loosening of the assembly retaining the mantle, due to either wear or operating forces applied to the head assembly, the usual forces acting on the retaining assembly during operation cause it to be self tightening, thereby preventing loosening of the mantle with respect to the head.

In accordance with this invention a self tightening mantle retention assembly for a conical crusher having a crusher bowl, and a frustoconically shaped head member supporting a frustoconically shaped mantle for gyration within the crusher bowl for crushing material between the crusher bowl and said mantle is provided. A locking bolt or nut is provided which has an externally threaded portion which is received in a threaded aperture in the head member. The locking bolt is provided with a cylindrical ridge or surface for applying a force to an upper edge of the mantle, such that engagement of the locking bolt externally threaded portion in the threaded aperture in the head member applies a force to secure the mantle to the head member (e.g., at the upper edge of the mantle). A hole is provided through the locking bolt such that a central or a conventional bolt having a head at one end and being threaded at the other end may pass therethrough. A second threaded aperture is associated with the head member such that the threads of the central bolt may be engaged therewith. Tightening of the central bolt, with the bolt head engaging the locking bolt, creates a compressive force between the head member and the locking bolt to further secure the mantle to the head member. The threads of the first aperture and the locking bolt are provided in a direction, such that the rotational force applied to the head by the material being crushed is in a direction to tighten the engagement of the threaded portion of the locking bolt in the first threaded aperture.

The present invention further relates to a mantle retention apparatus for use in a conical crushing system. The conical crushing system includes a crushing head supporting a mantle. The crushing head has a first threaded portion and a second threaded portion. The mantle retention apparatus includes a locking piece or locking bolt and a locking member or central bolt. The locking piece has a third threaded portion configured to engage the first threaded portion. The locking piece also includes an aperture. The locking member is disposed through the aperture of the locking piece. The locking member includes a fourth threaded portion configured to engage the second threaded portion. The locking member creates a compressive force between the locking member and the locking piece.

The present invention even further relates to a self tightening system for securing a mantle to a crushing head in a rock crusher. The crushing head includes a main aperture having a main thread pattern. The self tightening system includes a securing means for engaging the main threaded pattern and securing the mantle on the crusher head and locking means for providing a compressive force between the crusher head and the securing means. The compressive force serves to lock the securing means with respect to the crusher head.

BRIEF DESCRIPTION OF THE DRAWINGS

FIG. 1 is a cross-sectional view of a conical gyratory crusher showing a mantle retaining assembly of the prior art;

FIG. 2 is an enlarged cross-sectional view of the mantle retaining assembly of the prior art as shown in FIG. 1;

DETAILED DESCRIPTION OF THE PREFERRED EMBODIMENTS

Figure 3:
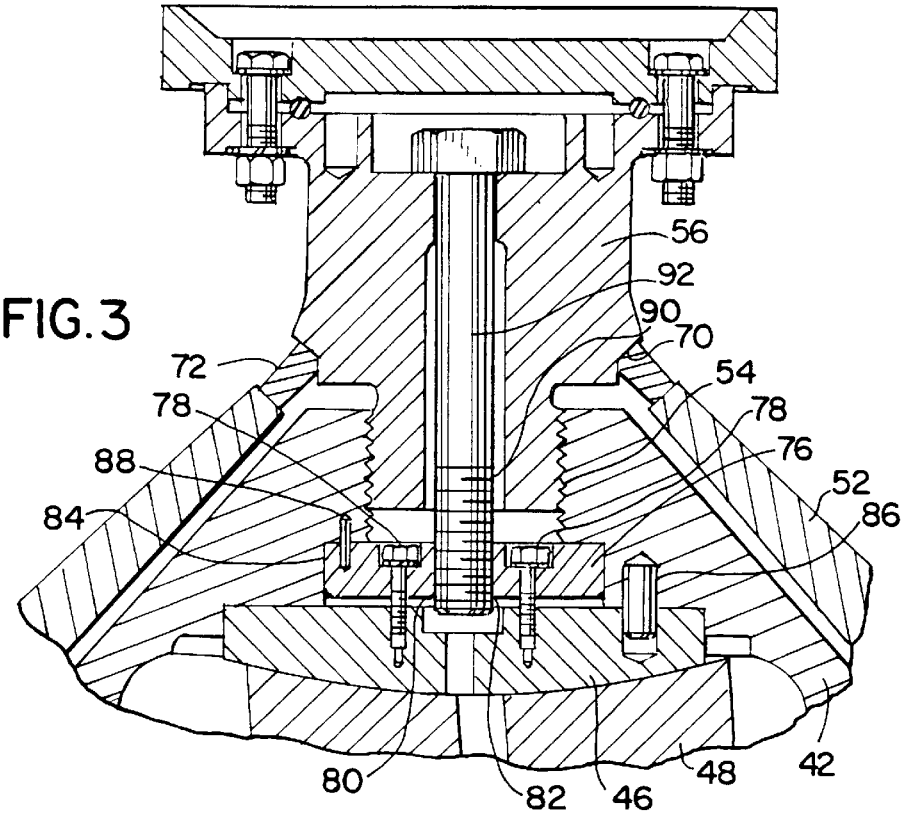
FIG. 3 is an enlarged cross-sectional view of a conical gyratory crusher, of the type shown in FIG. 1, provided with a self tightening mantle retaining assembly in accordance with this invention.

Referring to FIG. 1, the principal components of a gyratory type conical crusher provided with a mantle retaining assembly in accordance with the prior art is shown. For a more complete understanding of the overall assembly of a gyratory type conical crusher, reference may be made to U.S. Pat. No. 4,750,679 issued on Jun. 14, 1988 to Vijia Kumar Karra and Anthony J. Magerowski, which patent is assigned to the assignee of the subject application.

The principal components of a gyratory conical crusher 10 of the prior art, as shown in FIG. 1, are assembled on a main frame 12. Crusher 10 is shown with short head design on the left side of the drawing and a standard head on the right side of the drawing. The size, specific design, and shape of crusher 10 are not shown in a limiting sense with respect to the present invention described with reference to FIGS. 3 and 4. The main frame 12 includes a cylindrical support shell 14, the upper end of which is formed as an annular ring 16. The annular ring 16 is provided with an adjustment ring seat 18 upon which is supported an adjustment ring 20. The adjustment ring 20 adjustably supports a crusher bowl 22, which is provided with a bowl liner 24.

The main frame 12 also includes a central hub 26 which supports a stationary cylindrical support shaft 28, which in turn supports a crusher head assembly 30 through an eccentric 32 which rotates about the cylindrical support shaft 28. Rotation is imparted to the eccentric 32 by an annular gear 34 which is driven by a pinion 36 secured to one end of a shaft 38 which is supported by the main frame 12. Secured to the opposite end of the shaft 38 is a pulley 40 which is connected by a suitable belt, (not shown) to a prime mover (not shown).

Referring to FIGS. 1 and 2, a head member 42 is supported on the top of the shaft 28 by a spherical bearing assembly 44 which includes a spherical upper bearing or head ball block 46 and a socket bearing or spherical seat 48. A cylindrical bearing 50, provided on the head member 42, engages the outer periphery of the eccentric 32 to thereby cause gyration of the head assembly 30.

Supported on the head member 42 is a replaceable mantle 52. In accordance with the prior art, the replaceable mantle 52 is secured to the head member 42 by a retaining mechanism which is best shown in FIG. 2. Referring to FIG. 2, the head member 42 is provided with a threaded bore 54 for receiving an externally threaded portion of a locking bolt 56. Alternatively, locking bolt 56 can be a nut or other threaded member configured to engage an externally threaded portion on head member 42. Fastened to the lower end of the locking bolt 56 is a retention plate 58. The retention plate 58 is secured to the locking bolt 56, with a thin spacer or small separation therebetween, by a pair of bolts 60 and 62. The small separation may be provided by shoulder bolts which bear on locking bolt 56. With the retention plate 58 secured to the locking bolt 56, external threads are formed, at the same time, on both the retention plate 58 and the locking bolt 56. After the threads are formed on both the locking bolt 56 and the retention plate 58, the thin spacer between the two is removed. A central bore 64 is formed in the locking bolt 56, with the diameter of an upper portion 66 of the bore 64 being somewhat smaller and internally threaded than a lower portion, so as to receive the external threads of a jack bolt 68.

In assembling the mantle 52 on the head assembly 30, the mantle 52 is placed over the head member 42 with the inner lower edge of the mantle 52 engaging the outer lower edge of the head member 42, so as to prevent further downward movement of the mantle 52. The locking bolt 56, with the retention plate 58, attached thereto by the bolts 60 and 62 is threaded into the head member 42, to bring a cylindrical or surface 70 of the locking nut into engagement with one edge of frustoconical ring 72, the other edge of which engages the upper edge of the mantle 52. The locking bolt 56 is threaded into head member 42, so as to provide the desired compressive force on the upper edge of mantle 52. With the desired compressive force applied to mantle 52, the jack bolt 68 is rotated to apply a compressive force to a rod 74 located in the bore 64. This compressive force is applied to the top of the retention plate 58 thereby pushing it away from the lower edge of the locking bolt 56. This force, tending to cause the separation of the locking bolt 56 and the retention plate 58, also causes the locking bolt 56 and retention plate 58 to apply pressure to the threads in threaded bore 54 in the head member 42 in opposite axial directions, thereby causing the locking of head member 42 with respect to locking bolt 56.

This locking mechanism functions to provide resistance to loosening of the locking bolt during idling conditions when there is no material being crushed and consequently no strong tendency to self tighten. Similarly, it provides resistance to loosening under abnormal crushing conditions. However, during normal crushing conditions in which the lock bolt 56 forcefully self tightens into the head 42, the resistance of the retention plate 58 to turning often results in mechanical damage. Specifically, bolt 60 sometimes shear allowing the lock bolt 56 to wedge tightly into the retention plate 58 as the lock bolt advances. Also, the retention plate 58 is sometimes deformed due to the rod 74 pushing down on the center of the retention plate 58. Additionally, thread damage sometimes occurs to any or all of the threads between lock bolt 56 and mating threads of retention plate 58 and head 42. After sustaining such damage, removal of the lock bolt 56 and retention plate 58 becomes a major undertaking, sometimes involving either cutting the components into several pieces for removal, or drilling them out. Additionally, it may be necessary to restore the threads in the bore of the head member 42 before reassembly with a new lock bolt assembly.

These problems of the prior art retention system have been reduced by use of the self tightening mantle retention assembly of this invention. Referring to FIG. 3, the use of the self tightening mantle retention assembly of this invention, in place of the prior art retention system shown in FIGS. 1 and 2, will be explained. With the locking bolt 56 and the retention plate 58 removed from the head member 42, and the head member 42 lifted off of the spherical seat 48, a conical crusher as shown in FIGS. 1 and 2 may be provided with the self tightening mantle retention assembly of this invention.

A cylindrical block 76 is secured to the upper surface of the head ball 46 by bolts 78. A central aperture 80 in the block 76 is provided with internal threads 82. The head member 42 is provided with an enlarged cylindrical bore 84 to receive the cylindrical block 76. To prevent rotation between the head ball 46 and the head member 42, locating pins, such as 86, are provided. Similarly, pins 88 may be provided to prevent rotation between the head member 42 with respect to the cylindrical block 76. As in the prior art, the locking bolt 56 is threaded into the threaded bore 54 of the head member 42. When the proper retention compressive force has been applied to the mantle 52 through the engagement of the conical surface 70 of the locking bolt 58 with one edge of frustoconical ring 72, the other edge of which engages the upper edge of the mantle 52, a threaded end 90 of a central bolt 92 is engaged in the internal threads 82 of the cylindrical block 76.

When the eccentric 32 of a crusher rotates in a counterclockwise direction, as viewed from the top, the force applied to the mantle by the material being crushed is in a counterclockwise direction. By providing left-handed threads on the locking bolt 56, the counterclockwise force applied to it through its engagement with the mantle 52 through frustoconical ring 72 will cause further tightening of the locking bolt 56. Thus, the mantle retention system of this invention is self tightening. Further, only the usual axial forces exist between the threads of the head member 42 and the locking bolt 56, such that thread damage between the head and the lock bolt, as may occur in the prior art, does not occur.

During periods of idling or during abnormal crushing conditions, such as light or intermittent feeding of material to be crushed, the central bolt 92 constrains the lock bolt 56 from screwing out of the head 42 should the lock bolt 56 be forced in the direction of becoming loose. When normal crushing is resumed, the lock bolt 56 again self tightens and forcefully secures the mantle 52 to the head 42. Central bolt 92 may be of the generic type often described as locking or self locking threaded fasteners.

Figure 4:
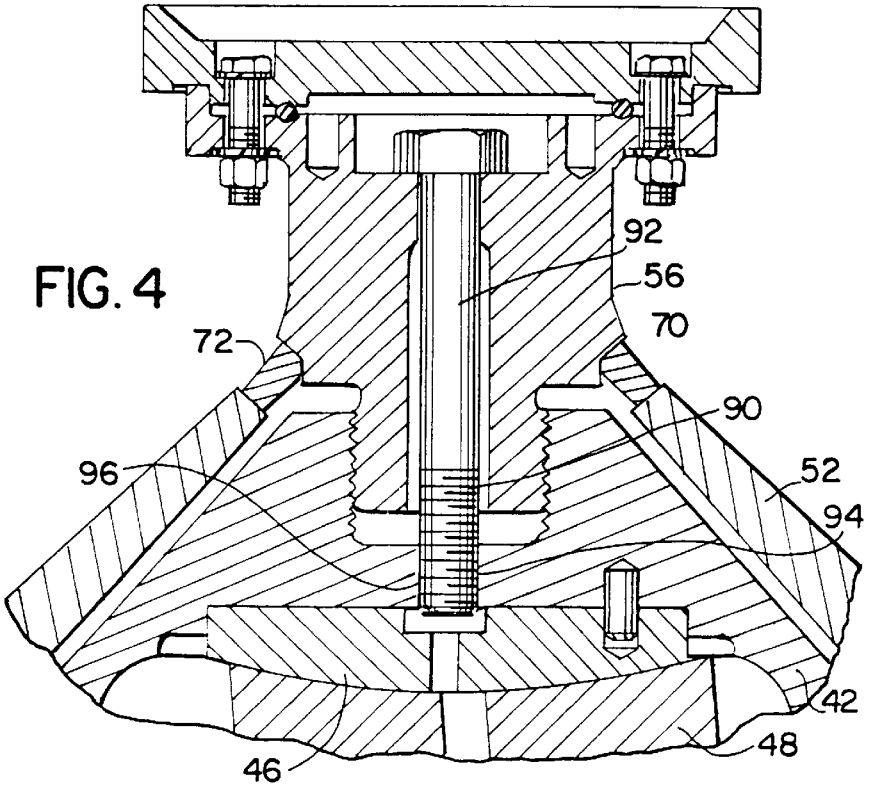
FIG. 4 is an enlarged cross-sectional view, corresponding to FIG. 3, of an alternate embodiment of the self-tightening mantle retaining assembly of this invention.

Referring to FIG. 4, a second embodiment of this invention is shown. This embodiment is very similar to that shown in FIG. 3. In the second embodiment the self tightening mantle retention assembly is preferred for a new crusher rather than as modification to a crusher originally constructed to use the retention system of the prior art as shown in FIGS. 1 and 2. The embodiment shown in FIG. 4 differs from that shown in FIG. 3 in that rather than being provided as a separate piece, the cylindrical block 76 is formed integrally with the head member 42. A reduced diameter bore 94 is provided with threads 96 for mating with the threaded end 90 of the central bolt 92.

As in the embodiment shown in FIG. 3, the embodiment shown in FIG. 4 not only prevents loosening between the locking bolt 56 and the head member 42, but it is also self tightening in the same manner as described with respect to the embodiment of FIG. 3.

While two embodiments of the invention have been shown, it should be apparent to those skilled in the art that what have been described are considered at present to be the preferred embodiments of the self tightening mantle retention assembly of this invention. For example, although particular threaded surfaces, nuts, bolts and types of threads are described, other elements may be threaded in particular ways to achieve the same effects. In accordance with the patent statute, changes may be made in the self tightening mantle retention assembly without actually departing from the true spirit and scope of this invention. The appended claims are intended to cover all such changes and modifications which fall in the true spirit and scope of this invention.

What is claimed is:

1. A self tightening mantle retention assembly for a conical crusher having a crusher bowl, said self tightening mantle retention assembly comprising:

a frustoconically shaped head member having a first threaded aperture formed therein and a second threaded aperture associated therewith;

a frustoconically shaped mantle supported on the head member and adapted to gyrate within the crusher bowl;

a locking bolt having an externally threaded portion engaged in said first threaded aperture of said head member, and a cylindrical ridge for applying a force to an upper edge of said mantle, such that engagement of said locking bolt externally threaded portion in said first threaded aperture applies a force to secure said mantle to said head member; and a central bolt having a head at one end and being threaded at the other end, said central bolt passing through a hole in said locking bolt with said threads of said central bolt being engaged in said second threaded aperture of said head member, whereby tightening of said central bolt, with said central bolt head engaging said locking bolt, creates a compressive force between said head member and said locking bolt, the threads of said first and second apertures and the threads of said locking bolt and of said central bolt being in a direction, such that the rotational force applied to said head by the material being crushed is in a direction to tighten the engagement of said threaded portion of said locking bolt in said first threaded aperture, and said threads of said central bolt in said second threaded aperture.

2. The self tightening mantle retention assembly of claim 1, wherein said second threaded aperture is formed in a block received in a cavity in said head member which cavity is shaped to receive said block.

3. The self tightening mantle retention assembly of claim 1, wherein said head member is supported on a spherical bearing assembly having a spherical bearing block and a spherical bearing seat, and said head member is secured to said spherical bearing block.

4. The self tightening mantle retention assembly of claim 1, wherein said second threaded aperture is formed in said head member.

5. The self tightening mantle retention assembly of claim 1, wherein said second threaded aperture is of a smaller diameter than said first threaded aperture.

6. The self tightening mantle retention assembly of claim 1, wherein said first and second apertures are coaxial.

7. The self tightening mantle retention assembly of claim 1, wherein a frustoconical ring is located between said upper edge of said mantle and said cylindrical ridge of said locking bolt.

8. A mantle retention apparatus for use in a conical crushing system, the mantle retention apparatus comprising:

a crushing head having a first threaded portion and a second threaded portion;

a mantle supported on said crushing head;

a locking piece having a third threaded portion configured to engage the first threaded portion of said crushing head, the locking piece having an aperture; and a locking member disposed through the aperture of the locking piece, the locking member including a fourth threaded portion configured to engage the second threaded portion of said crushing head, whereby the locking member creates a compressive force between the locking member and the crushing head.

9. The mantle retention apparatus of claim 8 wherein the locking piece is a locking bolt.

10. The mantle retention apparatus of claim 9 wherein the locking member is a bolt having a head at one end, the head being larger than the aperture, and the fourth threaded portion is at the other end.

11. The mantle retention apparatus of claim 8 wherein the second threaded portion is integral with the crushing head.

12. The mantle retention apparatus of claim 8 wherein the second threaded portion is within an aperture disposed on a plate, the plate being attached to the crushing head.

13. The mantle retention apparatus of claim 8 wherein the first and second threaded portions are each on an external surface within an aperture.

14. The mantle retention apparatus of claim 8 wherein the mantle retention apparatus is self tightened as the crushing head is moved.

15. A self tightening system for a rock crusher, the self tightening system comprising:

a crusher head including a main aperture having a main thread pattern;

a mantle supported on the crusher head;

securing means for engaging the main thread pattern on the main aperture of the crusher head and securing the mantle on the crusher head; and locking means for providing a compressive force between the crusher head and the securing means, the compressive force serving to lock the securing means with respect to the crusher head.

16. The self tightening system of claim 15 wherein the motion associated with the operation of the crusher head services to cause further tightening of the securing means with respect to the crusher head.

17. The self tightening system of claim 15 wherein the locking means includes a bolt, the bolt being threadably engaged to a second thread pattern located within the main aperture.

18. The self tightening system of claim 17 wherein the securing means is a lock unit having an external thread pattern for engaging the main thread pattern.

19. The self tightening system of claim 18 wherein the external thread pattern is left-handed.

20. The self tightening system of claim 19 wherein the bolt has a left-handed thread pattern.

21. A conical crushing system comprising:

a crushing head supporting a mantle, the crushing head having a first threaded portion and a second threaded portion; and a mantle retention apparatus including a locking piece and a locking member, the locking piece having a third threaded portion configured to engage the first threaded portion of the crushing head, the locking piece having an aperture, the locking member disposed through the aperture of the locking piece, the locking member including a fourth threaded portion configured to engage the second threaded portion of the crushing head, whereby the locking member creates a compressive force between the locking member and the crushing head.

* * * * *